US007051637B2

(12) United States Patent
Clark et al.

(10) Patent No.: US 7,051,637 B2
(45) Date of Patent: May 30, 2006

(54) MODULAR ARMOR SHIELD

(75) Inventors: Alfred Ray Clark, Virginia Beach, VA (US); Dale Alan McClellan, Chesapeake, VA (US)

(73) Assignee: Special Tactical Services, L.L.C., Chicago, IL (US)

( * ) Notice: Subject to any disclaimer, the term of this patent is extended or adjusted under 35 U.S.C. 154(b) by 0 days.

(21) Appl. No.: 10/445,776

(22) Filed: May 27, 2003

(65) Prior Publication Data

US 2006/0086242 A1 Apr. 27, 2006

(51) Int. Cl.
*F41H 5/013* (2006.01)

(52) U.S. Cl. ..... 89/36.06; 89/36.07

(58) Field of Classification Search ..... 89/36.04, 89/36.06, 36.07, 36.09, 36.12, 36.15, 36.16
See application file for complete search history.

(56) References Cited

U.S. PATENT DOCUMENTS

| | | | | | |
|---|---|---|---|---|---|
| 38,845 | A | * | 6/1863 | Saviers | 89/36.09 |
| 1,281,400 | A | * | 10/1918 | Larnell | 89/36.09 |
| 1,304,541 | A | * | 5/1919 | Clark | 89/36.09 |
| 3,590,685 | A | * | 7/1971 | Lane | 89/36.09 |
| 3,708,932 | A | * | 1/1973 | Bailey et al. | 52/232 |
| 4,410,214 | A | * | 10/1983 | Geschwender | 297/118 |
| 4,677,896 | A | * | 7/1987 | Litvinoff | 89/36.08 |
| 5,160,049 | A | * | 11/1992 | McMillen, Jr. | 211/85.2 |
| 5,293,807 | A | | 3/1994 | Hajdu | |
| 5,377,577 | A | | 1/1995 | Bounkong et al. | |
| 5,850,052 | A | | 12/1998 | Gabriel | |
| 5,857,730 | A | | 1/1999 | Korpi et al. | |
| 6,119,383 | A | * | 9/2000 | Gruneisen, III | 40/492 |
| 6,435,071 | B1 | * | 8/2002 | Campbell | 89/36.08 |
| 6,913,312 | B1 | * | 7/2005 | Clary et al. | 297/118 |
| 2003/0024174 | A1 | * | 2/2003 | Bonds et al. | 52/79.1 |
| 2003/0167911 | A1 | * | 9/2003 | White | 89/36.07 |

FOREIGN PATENT DOCUMENTS

| | | | | |
|---|---|---|---|---|
| FR | 2 607 238 A | * | 5/1988 | 89/36.04 |
| JP | 6-221796 | * | 8/1994 | |
| WO | WO 97/18726 | * | 5/1997 | |

* cited by examiner

*Primary Examiner*—Stephen M. Johnson
(74) *Attorney, Agent, or Firm*—Inna Shestul

(57) ABSTRACT

An armored shield includes an armor plate, an elongated spine member and a securing snap member. The modular armored shield is formed of the armor plate placed on two resting surfaces of a backside of the spine member with a hump portion of the elongated spine member extending through an armor plate slot and a securing snap member being mounted to the hump portion of the spine member with the hump portion extending through a securing snap slot. A modular armored shield assembly includes a plurality of armor plates joined at edges where at least one of two adjacent plates has threaded studs extending from the surface thereof and the other of said two adjacent plates has edges slots opening to the edge thereof at positions corresponding to positions of the studs. The modular armored shield assembly further includes a securing strip. The armor shield assembly is formed of two armor plates attached to one another by sliding the threaded studs into the edge slots, placing the securing strip on the threaded studs and screwing nuts onto the threaded studs.

10 Claims, 4 Drawing Sheets

MODULAR ARMOR SHIELD

BACKGROUND

1. Field of Invention

The present invention relates generally to an armored shield and more particularly to a modular armored shield that can be assembled and re-assembled depending on the circumstances; the shields are easily portable.

2. Description of Related Art

As is well known there is a need for personal protection from small arms ammunition as well as armor piercing ordinance for a person on ground or on ships. Various portable shields are known for providing body protection for the user. Examples of devices generally related to this art include U.S. Pat. No. 5,293,807 issued on Mar. 15, 1994 to Sandor Hajdu (Bullet Proof Shield Assembly); U.S. Pat. No. 5,377,577 issued on Jan. 3, 1995 to Bounkong et al. (Ballistic Shield); U.S. Pat. No. 5,850,052 issued on Dec. 15, 1998 to Wendell Gabriel (Padded Safety Shield); U.S. Pat. No. 5,857,730 issue on Jan. 12, 1999 to Kopri et al. (Low Visibility Armor Structure with Add-On Window Armor Component); U.S. Pat. No. 6,067,889 issued on May 30, 2000 to James C. Brown (Portable Combat Bunker); U.S. Pat. No. 6,131,524 issued on Oct. 17, 2000 to John P. Nepper, Sr. (Guardsman Shield for Opposably Parrying a Hostile Assailant); U.S. Pat. No. 6,367,363 issued on Apr. 9, 2002 to Widmont (Dual Protective Shield).

However, none of the shields disclosed in this prior art provides adequate personal protection while being easily transported and assembled. In this regard, most prior art shield structures have typically been of a unitary type, providing minor protection to individual body parts, some of the prior art shields require that users be in a prone position.

Therefore, it is an object of this invention to provide a modular armor shield that provides enhanced general protection for upright users but is easy to transport and assemble. Further, it is an object of this invention to provide such a shield that can be used as a gun mount.

It is another object of the present invention to provide a new and improved bulletproof shield assembly, which may be easily and efficiently manufactures and marketed.

It is a further object of the present invention to provide a new and improved shield assembly of a durable and reliable construction.

Another object of the present invention is to provide a new and improved armored shield assembly which is susceptible of a low cost of manufacture with regard to both materials and labor, and which accordingly is then susceptible of low prices of sale to consuming public, thereby making such armored shield assemblies economically available to the buying public.

SUMMARY OF THE INVENTION

According to principles, one embodiment of this invention, an armored shield includes an armor plate, an elongated spine member and a securing snap member. The modular armored shield is formed of the armor plate placed on two resting surfaces of a backside of the spine member with a hump portion of the elongated spine member extending through an armor plate slot and a securing snap member being mounted to the hump portion of the spine member with the hump portion extending through a securing snap slot.

In the present embodiment the elongated spine member has a supporting surface for supporting the armor shield from a supporting floor, such as ground or floor of a ship. Further, the supporting surface, in one embodiment has a base plate for improving this support.

Also, in the present embodiment the elongated spine member defines a pintle mount. The armor shield also includes a pintle plate for supporting a weapon. The pintle mount of the spine member is used to support the pintle plate. Furthermore, in one embodiment the elongated spine member has a pad eye for lifting the armor shield.

Furthermore, personal safety can best be achieved when the spine member supports the armor plate from the floor at an angle of 80°–60° to the floor with a deflection angle 10°–30° between the armor plate and a vertical line at the floor. Better results are achieved when the spine member supports the armor plate at an angle of 75°–65° with the deflection angle 15°–25° between the armor plate and the vertical line at the floor. However, the best results appear to be achieved when the spine member supports the armor plate from the floor at an angle approximately 70° with the deflection angle approximately 20°.

BRIEF DESCRIPTION OF THE DRAWINGS

These together with other objects of the present invention, along with the various features of novelty, which characterize the invention, are pointed out with particularity in the claims annexed to and forming a part of this disclosure. For a better understanding of the invention, its operating advantages and the specific objects attained by its uses, reference should be made to the accompanying drawing and descriptive matter in which there is illustrated preferred embodiments of the invention.

DETAILED DESCRIPTION OF THE PREFERRED EMBODIMENT

Figure 1:
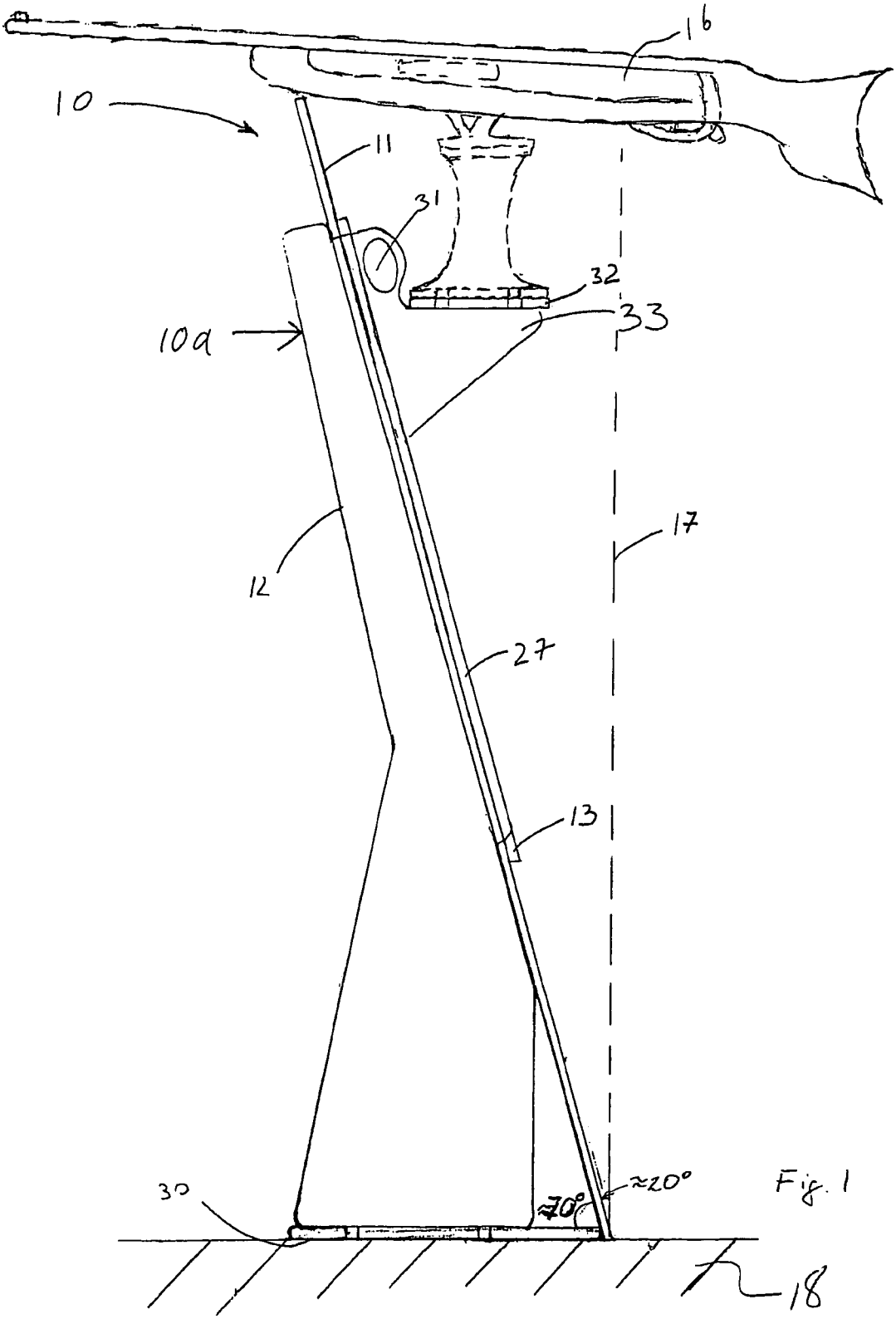
FIG. 1 is a side elevation of an armored shield of this invention showing one armor plate placed on one longitudinal lifting spine member.
Figure 6:
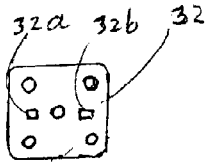
FIG. 6 is a top view of a pintle plate of the armor shield of FIG. 1.

With references to the drawings, a modular armored shield 10, formed of a single armor plate unit 10*a*, of this invention is shown in FIG. 1 to be constructed generally of an armor plate 11, an elongated spine member 12 and a securing snap member 13.

Figure 2:
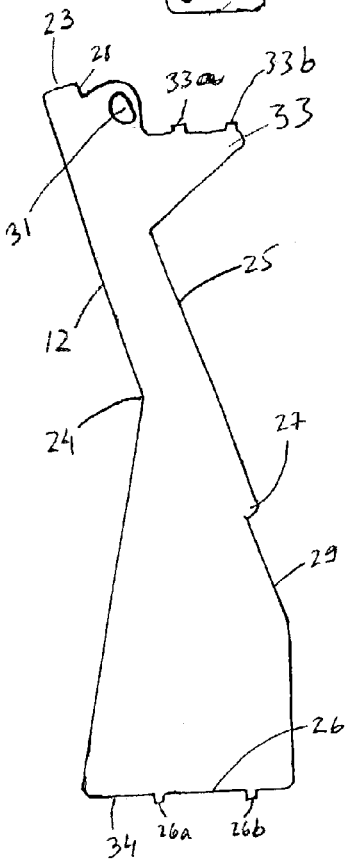
FIG. 2 is a side elevation of the spine member of FIG. 1.
Figure 3:
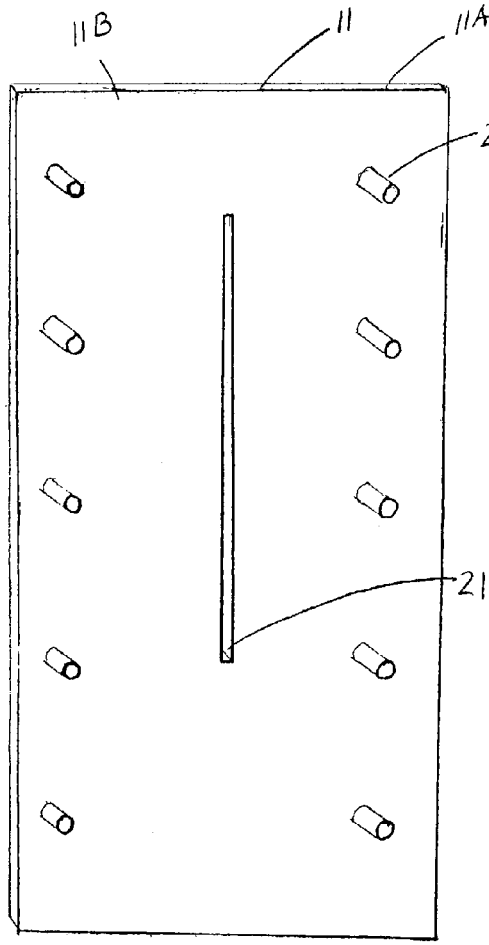
FIG. 3 is an isometric view of the armor plate of FIG. 1.
Figure 4:
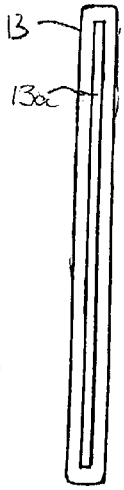
FIG. 4 is a backside view of a securing snap member of the armor shield of FIG.
Figure 5:
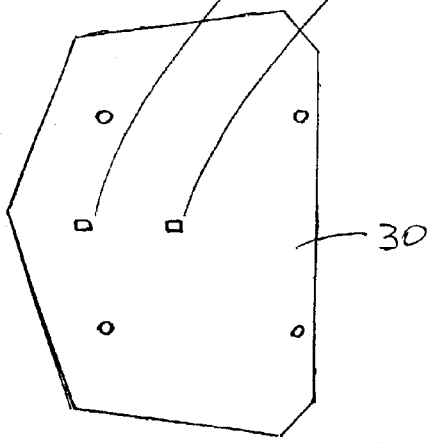
FIG. 5 is a top view of a base plate of the armor shield of FIG. 1.
Figure 7:
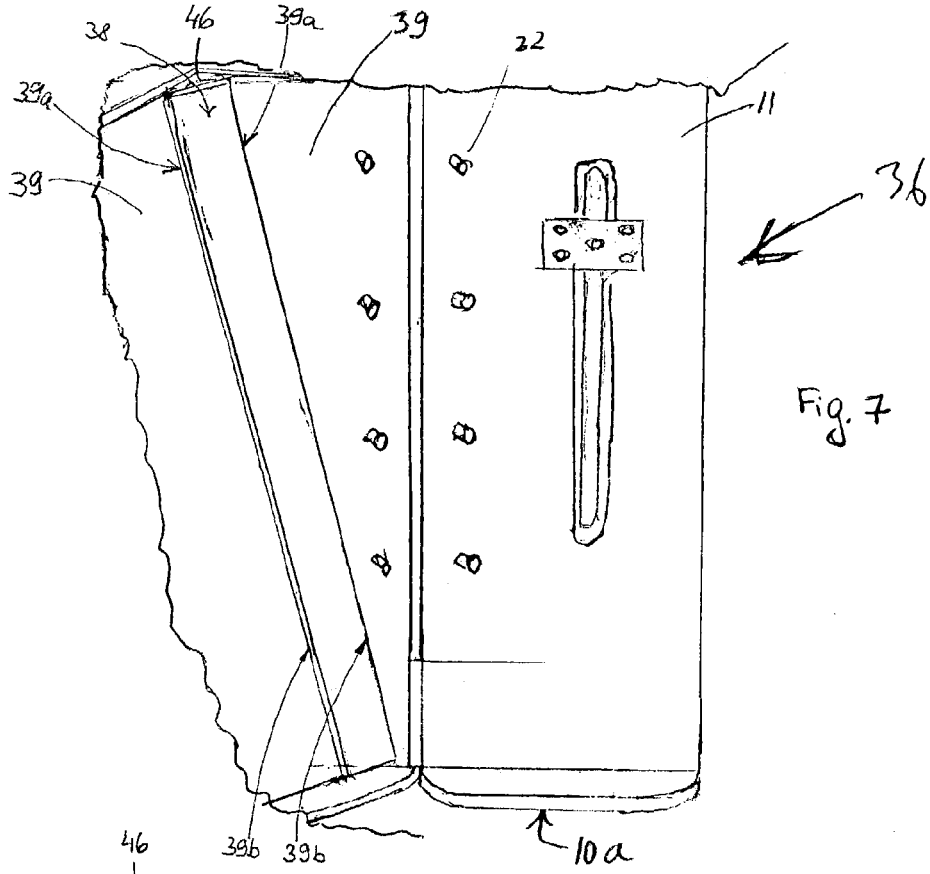
FIG. 7 is an isometric vie of the armor plate of FIG. 1 adjacent an angled armor plate of this invention.
Figure 9:
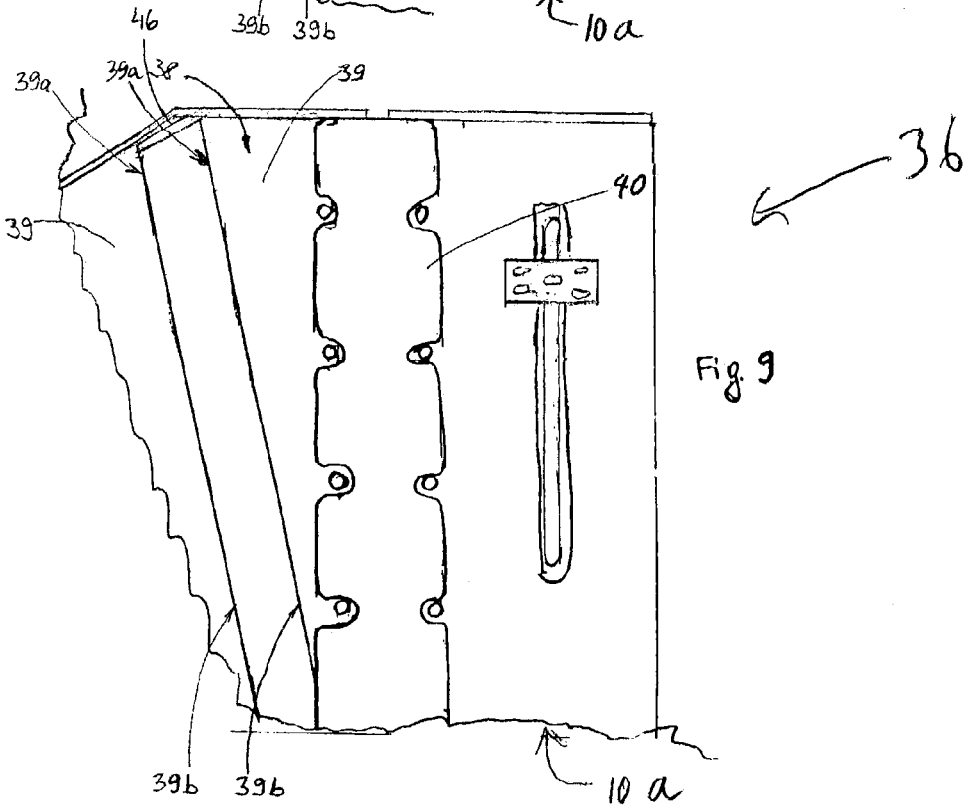
FIG. 9 is an isometric view of the overlap strip of FIG. 8 on the two adjacent armor plates of FIG. 7.
Figure 10:
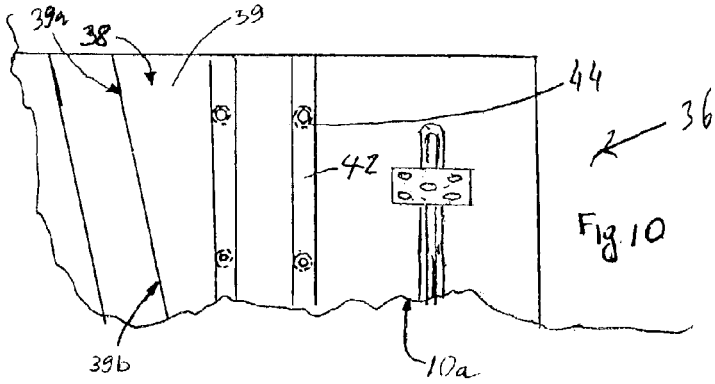
FIG. 10 is a cutaway elevation of a segment of the structure of FIG. 9, but also having securing strips of FIG. 8 mounted thereon.
Figure 8:
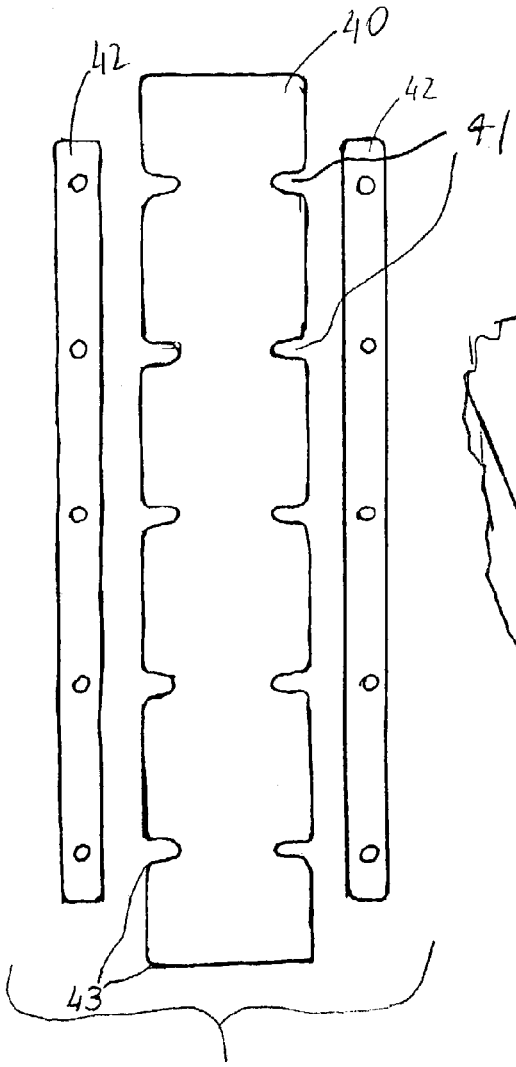
FIG. 8 is an exploded backside view of an overlap plate and two securing strips that are used for attachment of two armor plates of this invention.
Figure 11:
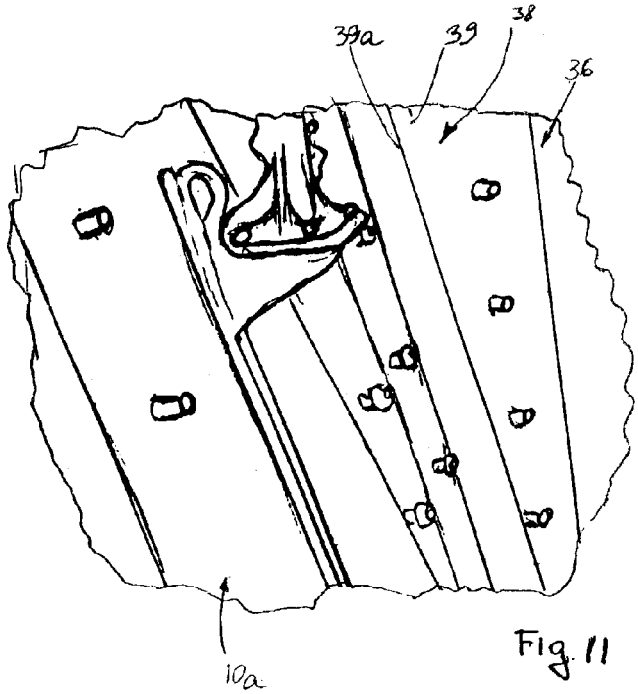
FIG. 11 is a cutaway isometric view of a section of the structure shown in FIG. 10.

As shown in FIG. 2, the armor plate 11 has two sides a front side 11A and a backside 11B. The armor plate defines an armor plate slot 21 and has a plurality of connecting studs 22 along opposite longitudinal edges extending from the backside of the plate. The armor plate may be formed from AR500 (Abrasion resistance) material. The armor plate is rectangular or flat plate, which in one embodiment is ½" thick. In another embodiment longitudinal the armor plate is ⅜" thick.

The elongated spine member 12 is basically an upright plate having a top portion 23, a front side 24, a backside 25, and a bottom edge 26. The backside 25 further includes a hump portion 27 that extends longitudinally along the backside, where the backside defines two resting surfaces 28 and 29 adjacent to the hump portion 27. The securing snap member 13 is a plate defines a securing snap slot 13*a* that approximately corresponds to the shape and size of the armor plate slot 21.

As shown in FIG. 1, the modular armored shield is formed by placing the armor plate 11 on the two resting surfaces 28 and 29 respectively of the backside of the spine member 12 by extending the hump portion 27 of the elongated spine member through the armor plate slot 21 and mounting the securing snap 13 to the hump potion of the spine member. The armor plate slot and the securing snap slot are laser cut slots for a perfect fit. The securing snap is attached to the hump portion by being welded thereto on a side of the securing snap facing away from the armor plate. Thus, an integrity of the armor plate is not affected by this weld.

The bottom edge 26 of the elongated spine member 12 forms a supporting surface 34 for supporting the armor shield from a supporting floor 18, such as the ground or the floor of the ship.

As shown in FIG. 2, the bottom edge 26 of the elongated spine member further has a bottom edge that has two posts 26*a* and 26*b*; a base plate 30 that has a plurality of holes two of which 30*a* and 30*b* that approximately correspond to the shape and size of the two posts 26*a* and 26*b* of the bottom edge 26 of the spine member 12. The base plate 30 is attached to the bottom edge 26 of the spine member 12 by placing the posts 26*a* and 26*b* through the holes 30*a* and 30*b* respectively, and welding them to the base plate from a bottom of the base plate. Thus, the spine member 12 and the base plate 30 form a spine member assembly.

As shown in FIG. 2, the elongated spine member further 12 defines a pad eye 31 for lifting the armor shield. The pad eye 31 is placed in such position that the shield could be lifted without breaking. The elongated spine member 12 also defines a pintle mount 33 that has two posts 33*a* and 33*b*. The elongated spine member assembly further includes a pintle plate 32 for supporting a weapon 16. The above pintle plate 32 has a plurality of holes two of which 32*a* and 32*b* approximately correspond to the shape and size of the two posts 33*a* and 33*b* of the pintle mount 33. The pintle mount supports the pintle plate by placing the pintle mount posts 33*a* and 33*b* through the holes 32*a* and 32*b* respectively.

As shown in FIG. 1, personal safety can best be achieved when the spine member supports the armor plate from the floor at an angle of 80°–60° to the floor with a deflection angle 10°–30° between the armor plate and a vertical line 17 at the floor. Better results are achieved when the spine member supports the armor plate at an angle of 75°–65° with the deflection angle 15°–25° between the armor plate and the vertical line 17 at the floor. However, the best results appear to be achieved when the spine member supports the armor plate from the floor at an angle approximately 70° with the deflection angle approximately 20°.

With reference to FIGS. 7–11, an improved modular armored shield assembly 36 is shown in various stages of completion formed of a plurality of armor plate units, at least one of which is identical to that of FIG. 1. The modular armored shield assembly 36 includes a plurality of armor plates units joined at edges of armor plates thereof wherein at least one of two adjacent armor plates unit is like unit 10*a* depicted in FIGS. 1–6 another armor plate unit of the assembly is an angled armor plate unit 38 in which an angled armor plate 39 forms a 45° angle 39*a*. Further, a protective cap 46 is placed on a top of angled areas 39*b* of the angled armor plate 39 for enhancement of ballistic integrity of this plate. Each armor plate 11 and 39 has threaded studs 22 extending from the surface thereof. The shield assembly 36 also included an overlap plate 40 that has edges slots 41 opening to the edge thereof at positions corresponding to positions of connecting studs. The assembly further includes two securing strips 42. These two armor plates 11 and 39 are attached to one another by sliding the threaded studs 22 into the edge slots 41 of the overlap plate 40, placing the securing strips 42 on the threaded studs 22 and screwing nuts 44 onto the threaded studs. Thus the overlap plate 40 is also an armor plate that holds the two adjacent armor plates 11 and 39 of the armor plate units 10*a* and 38 together.

It should be noted that the overlap plate 40 is without the elongated spine member and is constructed to have rounded corners 43. The rounded corners improve the strength and enhance ballistic integrity of this member.

The above assembly provides 100% true overlapping ballistic integrity even if mounted on uneven ground. As to the manner of usage and operation of the instant invention, the same should be apparent from the above disclosure, and accordingly no further discussion relative to the manner of usage and operation of the instant invention shall be provided.

This invention provides the modular armor shield that provides enhanced general protection for upright users but is easy to transport and to assemble. Further, this invention provides the shield that can be used as a gun mount. The modular armor shield and modular armor shield assembly are constructed in such a way that construction does not adversely affect the armor qualities of the plates. Further, the angle provides additional protection by deflecting bullets. Finally, the angled armor plate allows the shield to be tailored to its location.

With regard to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

For example, although the combined armor plate units shown herein include adjacent non-angled and angled armor plates, it should be understood that two non-angled plates could be adjacent one another, as could two angled plates.

What is claimed is:

1. A modular armored shield, comprising:

an armor plate defining an armor plate slot;

an elongated spine member comprising an upright plate having a hump portion, the elongated spine member defining at least one resting surface, wherein the hump portion extends through the armor plate slot when the armor plate is placed against the one resting surface; and a securing snap member defining a securing snap slot corresponding to the armor plate slot; the securing snap member being mounted to the hump portion of the spine member with the hump portion extending through the securing snap slot, wherein the securing snap member is a plate with the slot for receiving the hump portion, wherein the elongated spine member includes a pad eye for lifting the armor shield, wherein the armor shield includes a pintle plate for supporting a weapon, the elongated spine member defining a pintle mount for supporting the pintle plate.

2. A modular armored shield, comprising:

an armor plate defining an armor plate slot;

an elongated spine member comprising an upright plate having a hump portion, the elongated spine member defining at least one resting surface, wherein the hump portion extends through the armor plate slot when the armor plate is placed against the one resting surface; and a securing snap member defining a securing snap slot corresponding to the armor plate slot; the securing snap member being mounted to the hump portion of the spine member with the hump portion extending through the securing snap slot, wherein the securing snap member is a plate with the slot for receiving the hump portion, wherein the armor shield includes a pintle plate for supporting a weapon, the elongated spine member defining a pintle mount for supporting the pintle plate.

3. A modular armored shield, comprising:

an armor plate defining an armor plate slot;

an elongated spine member comprising an upright plate having a hump portion, the elongated spine member defining at least one resting surface, wherein the hump portion extends through the armor plate slot when the armor plate is placed against the one resting surface; and a securing snap member defining a securing snap slot corresponding to the armor plate slot; the securing snap member being mounted to the hump portion of the spine member with the hump portion extending through the securing snap slot, wherein the securing snap member is a plate with the slot for receiving the hump portion, wherein the elongated spine member defines a support surface to support the armor plate from a floor, wherein the armor plate is supported on the floor at an angle of 80°–60°.

4. A modular armored shield, comprising:

an armor plate defining an armor plate slot;

an elongated spine member comprising an upright plate having a hump portion, the elongated spine member defining at least one resting surface, wherein the hump portion extends through the armor plate slot when the armor plate is placed against the one resting surface; and a securing snap member defining a securing snap slot corresponding to the armor plate slot; the securing snap member being mounted to the hump portion of the spine member with the hump portion extending through the securing snap slot, wherein the securing snap member is a plate with the slot for receiving the hump portion, wherein the elongated spine member defines the support surface to support the armor plate from the floor, wherein the armor plate is supported on the floor at an angle of 75°–65°.

5. A modular armored shield, comprising:

an armor plate defining an armor plate slot;

an elongated spine member comprising an upright plate having a hump portion, the elongated spine member defining at least one resting surface, wherein the hump portion extends through the armor plate slot when the armor plate is placed against the one resting surface; and a securing snap member defining a securing snap slot corresponding to the armor plate slot; the securing snap member being mounted to the hump portion of the spine member with the hump portion extending through the securing snap slot, wherein the securing snap member is a plate with the slot for receiving the hump portion, wherein the elongated spine member defines the support surface to support the armor plate from the floor, wherein the armor plate is supported on the floor at an angle is approximately 70°.

6. An apparatus comprising:

a first member and a second member, the first member being planar and having an elongated slot, first and second faces;

the second member defining a first portion and a second portion, the first portion too large to fit though the slot, and the second portion shaped to fit through the slot;

the second portion of the second member protruding through the first face and through the slot of the first member;

a snap member having an elongated slot;

the second portion of the second member protruding through the elongated slot of the snap member, the snap member disposed on the second face of the first member;

a third portion of the second portion of the second member, passing through the first member and the snap member, stand thereof;

the snap member welded to the second portion of the second member;

the first member not welded to the second member;

the first member not welded to the snap member.

7. The apparatus of claim 6, wherein the third portion of the second portion of the second member further comprises a pad eye.

8. The apparatus of claim 6, wherein the third portion of the second portion of the second member further comprises a pintle mount.

9. The apparatus of claim 6, wherein the first member has resistance of at least AR500.

10. The apparatus of claim 6, wherein the second member is perpendicular with the first member.

* * * * *